US006831560B2

(12) United States Patent
Gresset

(10) Patent No.: US 6,831,560 B2
(45) Date of Patent: Dec. 14, 2004

(54) SECURITY SUPPORT FOR DISPLAY ARTICLES

(75) Inventor: Eric Gresset, Jouy (FR)

(73) Assignee: S.A.A.A. Systemes d'Automatismes d'Alarmes Automatiques, Gallardon (FR)

( * ) Notice: Subject to any disclaimer, the term of this patent is extended or adjusted under 35 U.S.C. 154(b) by 0 days.

(21) Appl. No.: 10/311,967

(22) PCT Filed: Jun. 20, 2001

(86) PCT No.: PCT/FR01/01940

§ 371 (c)(1),
(2), (4) Date: Mar. 26, 2003

(87) PCT Pub. No.: WO01/97661

PCT Pub. Date: Dec. 27, 2001

(65) Prior Publication Data

US 2003/0159949 A1 Aug. 28, 2003

(30) Foreign Application Priority Data

Jun. 21, 2000 (FR) ..... 00 07954

(51) Int. Cl.[7] ..... G08B 13/14
(52) U.S. Cl. ..... 340/568.2; 340/568.8
(58) Field of Search ..... 340/568.2, 568.1, 340/568.4, 568.8, 571, 572.1, 572.8, 572.9; 248/114, 115, 116

(56) References Cited

U.S. PATENT DOCUMENTS 5,072,213 A * 12/1991 Close ..... 340/568.2
5,146,205 A * 9/1992 Keifer et al. ..... 340/568.2
5,341,124 A * 8/1994 Leyden et al. ..... 340/568.4
5,861,807 A 1/1999 Leyden et al. ..... 340/568.2
5,873,457 A 2/1999 Madweb ..... 206/301
6,027,277 A * 2/2000 Leyden et al. ..... 403/291
6,039,498 A * 3/2000 Leyden et al. ..... 403/61
6,087,939 A * 7/2000 Leyden et al. ..... 340/568.2
6,396,401 B1 * 5/2002 Matsuo ..... 340/568.4
6,570,502 B2 * 5/2003 Matsuo ..... 340/568.2

FOREIGN PATENT DOCUMENTS

FR 2752636 2/1998

* cited by examiner

*Primary Examiner*—Toan N. Pham
(74) *Attorney, Agent, or Firm*—Young & Thompson

(57) ABSTRACT

A security support for display article, in particular wristwatches, designed to be integrated in a display unit includes a sensor fixed on the base and connected by a conductor were to a connector linked to an alarm central station. The support consists of a globally cylindrical block whereof the side surface is truncated along a chord to form a plane whereon is fixedly mounted a mechanical locking member adapted to co-operate removably with corresponding parts of the sensor fixed at the base of the watch, such that the latter thus equipped with the sensor, can be mechanically locked on the cylindrical block by the locking member and can be locked on that same block by winding of its own bracelet and by closure of its clasp.

10 Claims, 4 Drawing Sheets

SECURITY SUPPORT FOR DISPLAY ARTICLES

CROSS REFERENCE TO RELATED APPLICATION

This is the 35 USC 371 national stage of International Application PCT/FR01/01940 filed on Jun. 20, 2001, which designated the United States of America.

FIELD OF THE INVENTION

This invention concerns a secured support for demonstration articles, notably wrist-watches intended to be integrated into a display rack.

More particularly, the invention concerns a secured support which enables the handling of articles, while leaving them connected to an alarm station in order to limit the risks of theft.

BACKGROUND OF THE INVENTION

In known protection systems enabling the handling of articles by potential buyers, a sensor is attached to the bottom of a watch, for example, and it is connected by a conductive wire to a connector in association with an alarm station.

This sensor is stuck and any attempt at detaching said sensor triggers the alarm.

Nevertheless, it has been noted that it is sometimes insufficient to attach the sensor to the bottom of the watch since the sensors used generally comprise a micro-switch held in compression by contact with the bottom of the watch and that it was not impossible to neutralise them by sliding a flat rigid object between the bottom of the watch and the sensor in order not to trigger the alarm.

It has therefore proven necessary to further strengthen the safety device.

SUMMARY OF THE INVENTION

To this end, the invention concerns a secured support for demonstration articles, notably wrist-watches, intended to be integrated into a display rack and comprising a sensor fixed to the bottom of the watch and connected by a conductive wire to a connector in association with an alarm station.

According to the invention, said support is composed of a substantially cylindrical block whereof the lateral surface is truncated along a cord in order to exhibit a plane whereon is added fixedly a mechanical locking member capable of co-operating removably with corresponding sections of the sensor whereof an upper plane is attached, removably, to a seat fixed to the bottom of the watch, so that said watch thus fitted with the sensor may, on the one hand, be locked mechanically to the cylindrical support by the locking member and, on the other hand, immobilised on said same support by winding and closing its own bracelet.

Thus, any malicious customer will have not only to attempt to get rid of the presence of the sensor, but he will also have to open the wristwatch and unlock the locking member.

This invention also concerns the characteristics which will appear in the following description and which will have to be considered individually or in all their technically possible combinations:

the mechanical locking member is composed of a U-shaped flat element whereof the open legs are parallel to one another and come from a semi-circular bottom whereof the diameter is greater than their spacing and substantially equal to that of a cylindrical seat of the sensor, in order to enable said sensor to snap into the U-shaped member in a resilient fashion;

the cylindrical seat of the sensor is mounted to rotate freely with respect thereto;

the cylindrical seat of the sensor forms, opposite its upper plane, a collar of diameter greater than said seat, capable of engaging under a shoulder formed of an enlarged lower section and of shape matching the locking member, for retaining said member axially;

the support comprises, on the base of the substantially cylindrical bloc that it forms, a curvilinear groove leading, on the one hand, to its upper plane closet to the open legs of the locking member and, on the other hand, to a lower zone of its cylindrical wall, in order to guide the conductive wire, spiral-wound or not, in its section situated close to the sensors;

the support comprises, on both bases of the cylindrical block that it forms, two axial toes protruding on either side of said bases and capable to be accommodated in two open housings in a forked fashion, of a shape matching said toes and realised on two stirrups of a display rack;

both axial toes are of square section whereof the value is substantially equal to that of the spacing of the forks formed by the stirrups of the display rack;

the support is made of moulded plastic material;

the support is made of wrought plastic material;

the support comprises a retaining element provided at the end of the plane of the cylindrical block of the curvilinear groove, intended for retaining the conductive wire when housed in the groove.

BRIEF DESCRIPTION OF THE INVENTION

This description is given for exemplification purposes, without being limited thereto, with reference to the appended drawings.

DETAILED DESCRIPTION OF THE INVENTION

Figure 1:
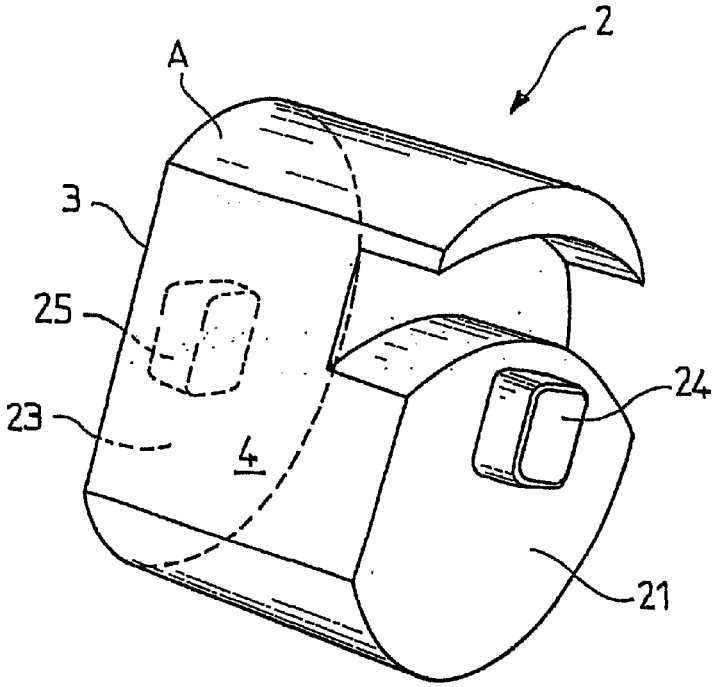
FIG. 1 is a perspective view of a secured support according to the invention.
Figure 2:
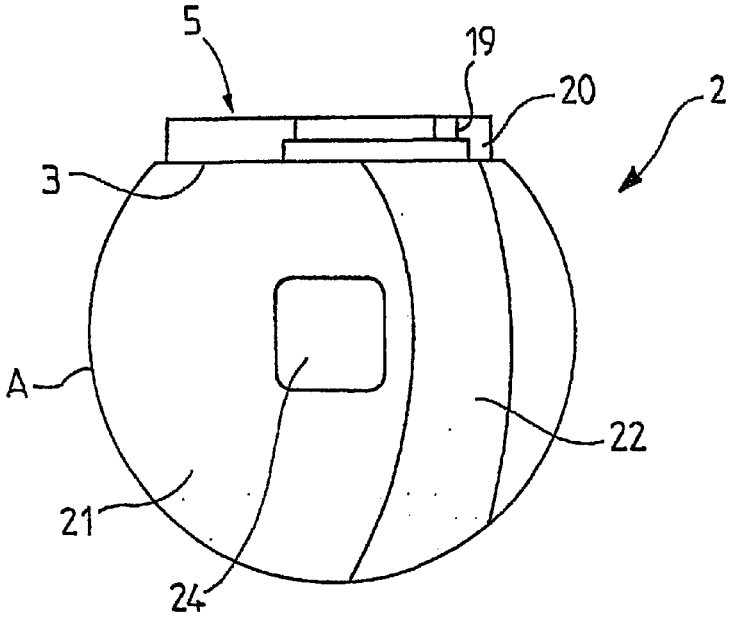
FIG. 2 is a side view of the secured support according to FIG. 1, after placing a locking member.
Figure 3:
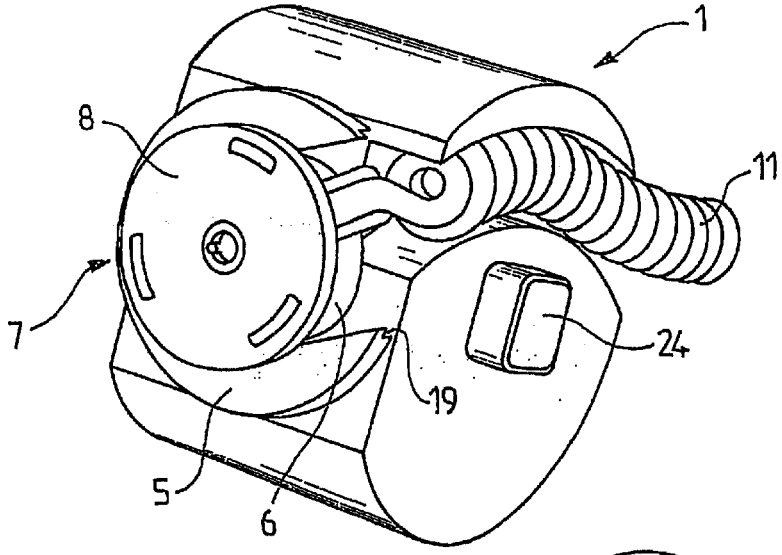
FIG. 3 is a perspective view of the secured support according to FIG. 1, after placing a locking member and a sensor.
Figure 4:
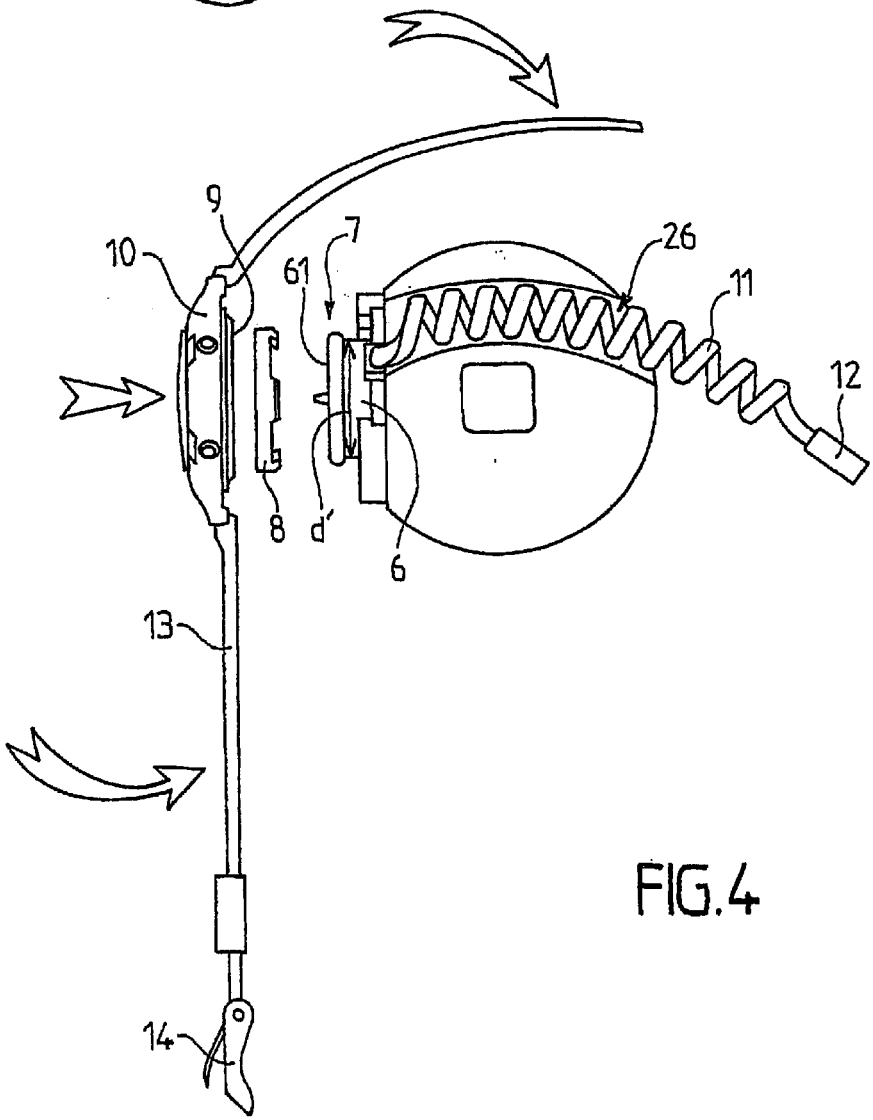
FIG. 4 represents the assembly of the secured support, the locking member, the sensor and a watch.
Figure 5:
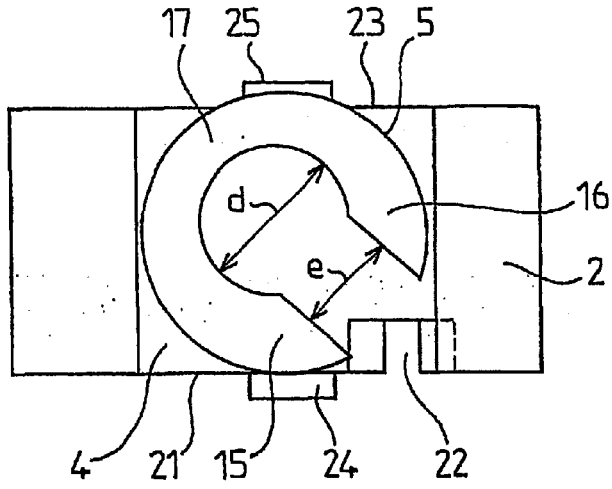
FIG. 5 is a top view of the support according to FIG. 2.
Figure 6:
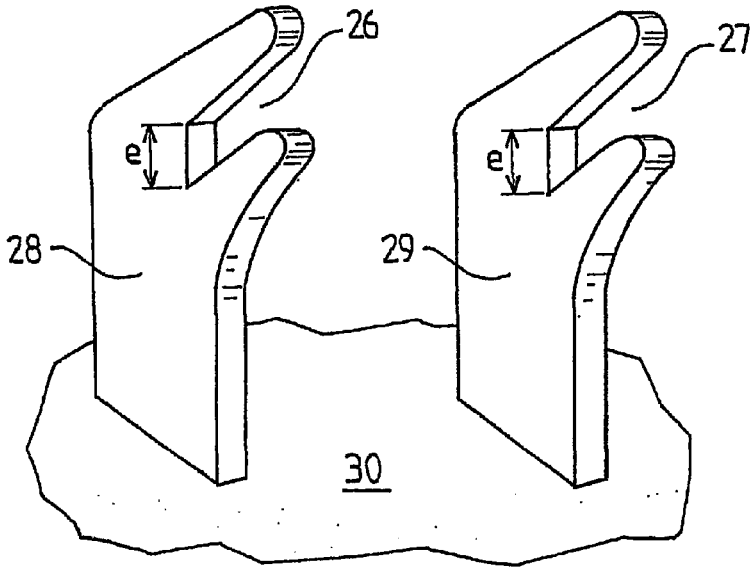
FIG. 6 represents an assembly of two stirrups for the secured support according to the invention.
Figure 7:
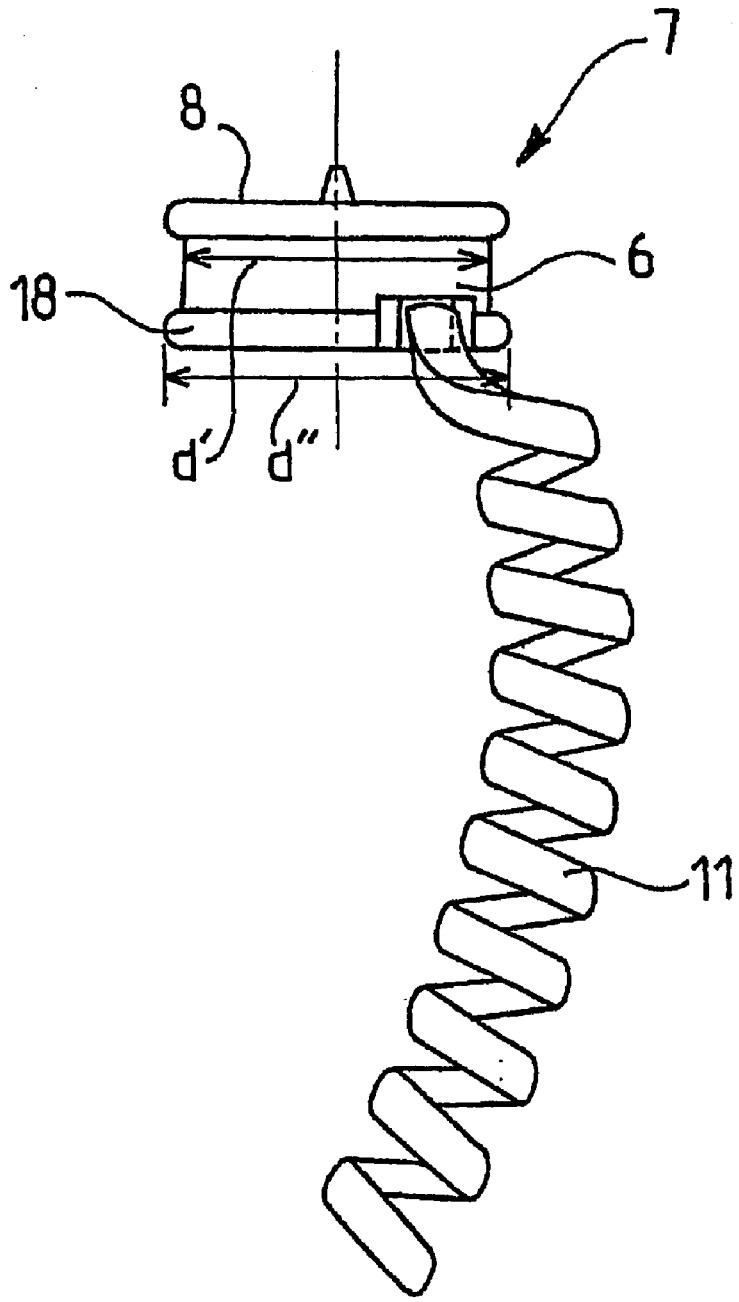
FIG. 7 represents a sensor for the secured support according to the invention.

The secured support 1 is composed of a cylindrical block 2 with a shell or a lateral surface A and two bases or end faces 21, 23. the lateral surface A is truncated along a cord 3 to exhibit a plane 4 whereon is added fixedly a mechanical locking member 5.

This mechanical locking member 5 is capable of co-operating removably with corresponding sections 6 of a sensor 7 whereof an upper plane 61 is intended to be attached, removably, as well, to a seat 8 fixed to the bottom 9 of a watch 10.

Thus, the watch 10 is not only linked by a conductive wire 11 to a connector 12 in association with an alarm station, but it is also locked mechanically to the cylindrical support 2 by the locking member 5 and it is moreover immobilised on said same support by winding its own bracelet 13 and by closing its clasp 14.

The mechanical locking member 5 is composed of a U-shaped flat element whereof the open legs 15 and 16 are parallel to one another and come from a semi-circular bottom 17 whereof the diameter d is greater than the spacing e of said legs 15 and 16. Said diameter d is substantially equal to that of a cylindrical seat 6 of the sensor 7.

Thus, the latter can snap into the U-shaped locking member 5 in a resilient fashion, according to a strength to be determined.

For retaining the sensor 7 axially, its cylindrical seat forms, opposite to its upper plane 8, intended to be fixed to the watch 9, a collar 18 of diameter d" greater than the diameter d' of said seat 6, whereas said collar 18 is capable of engaging under a shoulder 19 which is formed by an enlarged lower section 20, whereof the shape matches the locking member 5.

According to another characteristic of the invention, the cylindrical block 2 comprises on the base 21 a curvilinear groove 22 leading, on the one hand, to its upper plane 4 close to the open legs 15 and 16 of the locking member 5 and, on the other hand, in a lower zone of its cylindrical wall, in order to guide the conductive wire 11, spiral-wound or not, in its section situated close to the sensor 7.

Advantageously, the groove 22 is provided, at the far end of the plane 4, of a retaining element 26 intended for retaining the conductive wire 11 when said wire is housed in the cutting kerf 22. The retaining element 26 is, preferably, formed like a tooth engaging between two successive spirals of a spiral-wound wire 11.

Preferably, the cylindrical seat 6 of the sensor 7 is mounted to rotate freely with respect thereto, to enable adequate orientation of the conductive wire with respect to the curvilinear groove 22.

According to another characteristic of the invention, the secured support 1 comprises on both bases 21 and 23 of the cylindrical block 2 that it forms, two axial toes 24 and 25, protruding on either side of said bases 21 and 23 and capable of being accommodated in two housings 26 and 27, open as a fork, whereof the shape matches said axial toes 24 and 25 and realised on two stirrups 28 and 29 of a display rack 30.

According to this embodiment, both axial toes 24 and 25 are of square section whereof the value c of one side is substantially equal to that of the spacing e of the forks 26, 27 formed of the stirrups 28, 29 of the display rack 30.

Advantageously, the cylindrical block forming the secured support with its sensor is moulded of plastic material.

What is claimed is:

1. A secured support for demonstration articles, notably wrist-watches, intended to be integrated to a display rack (30) and comprising a sensor (7) fixed to the bottom (10) and connected by a conductive wire (11) to a connector (12) in association with an alarm station, characterised in that it is composed of a substantially cylindrical block (2) whereof the lateral surface is truncated along a cord (3) to exhibit a plane (4) whereon is added fixedly a mechanical locking member (5) capable of cooperating removably with corresponding sections (6) of the sensor (7) whereof an upper plane (61) is attached, removably, to a seat (8) fixed to the bottom (9) of the watch (10), so that said watch fitted with the sensor (7) may, on the one hand, be locked mechanically to the cylindrical block (2) by the locking member (5) and, on the other hand, be immobilised on said same block by winding its own bracelet (13) and by closing its clasp (14).

2. A support according to claim 1, characterised in that the mechanical locking member (5) is composed of a U-shaped flat element whereof the open legs (15, 16) are parallel to one another and come from a semi-circular bottom whereof the diameter (d) is greater than their spacing (e) and substantially equal to that (d') of a cylindrical seat (6) of the sensor (7), in order to enable said sensor to snap into the U-shaped member (5) in a resilient fashion.

3. A support according to claim 2, characterised in that the cylindrical seat (6) of the sensor (7) is mounted to rotate freely with respect thereto.

4. A support according to claim 2, characterised in that the cylindrical seat (6) of the sensor (7) forms, opposite its upper plane (61), a collar (18) of diameter (d") greater than said seat, capable of engaging into a shoulder (19) formed of an enlarged lower section (20) and of a shape matching the locking member (5), for retaining said member axially.

5. A support according to claim 1, characterised in that it comprises, on the base (21) of the substantially cylindrical block (2) that it forms, a curvilinear groove (22) leading, on the one hand, to its upper plane (4) close to the open legs (15, 16) of the locking member (5) and, on the other hand, in a lower zone of its cylindrical wall, in order to guide the conductive wire (11), spiral-wound or not, in its section situated close to the sensors (7).

6. A support according to claim 5, characterised in that it comprises a retaining element (26) provided at the far end of the plane (4) of the cylindrical block (2), of the curvilinear groove (22) intended for retaining the conductive wire (11) when it is housed in the groove (22).

7. A support according to claim 1, characterised in that it comprises on both bases (21, 23) of the cylindrical block (2) that it forms, two axial toes (24, 25) protruding on either side of said bases (21, 23) and capable of being accommodated in two open housings (26, 27) like forks, of shape matching said toes (24, 25) and realised on two stirrups (28, 29) of a display rack (30).

8. A support according to any of the claims 1 to 7, characterised in that it is made of a moulded plastic material.

9. A support according to claim 1, characterised in that it is made of a moulded plastic material.

10. A support according to claim 1, characterised in that it is made of wrought plastic material.

* * * * *